US007452104B2

(12) United States Patent
New et al.

(10) Patent No.: US 7,452,104 B2
(45) **Date of Patent: *Nov. 18, 2008**

(54) INFRARED FILTER SYSTEM FOR FLUORESCENT LIGHTING

(75) Inventors: Richard D. New, Plano, TX (US); Robert L. Burgess, deceased, late of Arlington TX (US); by Sonja Kaye Burgess, legal representative, Arlington, TX (US)

(73) Assignee: Luminator Holding, L.P., Plano, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/685,982

(22) Filed: Oct. 15, 2003

(65) Prior Publication Data

US 2004/0252507 A1 Dec. 16, 2004

Related U.S. Application Data

(63) Continuation-in-part of application No. 10/246,911, filed on Sep. 18, 2002, now Pat. No. 6,741,024, which is a continuation of application No. 09/296,921, filed on Apr. 22, 1999, now Pat. No. 6,515,413.

(51) Int. Cl.
*F21V 14/00* (2006.01)

(52) U.S. Cl. ..... 362/255; 362/223; 362/260; 362/293

(58) Field of Classification Search ..... 362/223, 362/255, 260, 293, 330
See application file for complete search history.

(56) References Cited

U.S. PATENT DOCUMENTS

| | | | | |
|---|---|---|---|---|
| 3,103,156 | A * | 9/1963 | Quin | 454/248 |
| 3,188,513 | A | 6/1965 | Hansler | |
| 3,636,398 | A | 1/1972 | Boyce | |
| 4,017,758 | A | 4/1977 | Almer et al. | |
| 4,112,331 | A | 9/1978 | Verbeek et al. | |
| 4,687,968 | A | 8/1987 | Frayer | |
| 4,792,716 | A | 12/1988 | Walsh | |
| 4,916,352 | A | 4/1990 | Haim et al. | |
| 5,234,871 | A * | 8/1993 | Krashkevich | 501/73 |
| 5,262,880 | A | 11/1993 | Abileah | |
| 5,536,998 | A | 7/1996 | Sica | |
| 5,610,469 | A | 3/1997 | Bergman et al. | |
| 6,157,504 | A * | 12/2000 | Yamada et al. | 359/885 |

OTHER PUBLICATIONS

Patent Abstracts of Japan, Fluorescent Lamp with Gel Composite Sealing Cover and its Manufacture, JP6325733, Nov. 25, 1994.

* cited by examiner

*Primary Examiner*—Sandra O'Shea
*Assistant Examiner*—Jason Moon Han
(74) *Attorney, Agent, or Firm*—Winstead PC

(57) ABSTRACT

A method and apparatus that effectively filters infrared light from fluorescent lighting and that is easily adapted to typical fluorescent lighting and assemblies. A fluorescent lighting fixture includes a cover for filtering the infrared light from a fluorescent light source of the fixture. The cover includes an infrared filter for substantially preventing emission of infrared light from the fluorescent lighting fixture and a protective layer for preventing damage to the infrared filter.

11 Claims, 6 Drawing Sheets

INFRARED FILTER SYSTEM FOR FLUORESCENT LIGHTING

CROSS REFERENCES TO RELATED APPLICATIONS

This application is a continuation-in-part of, and hereby incorporates by reference for any purpose, the entire disclosure of U.S. patent application Ser. No. 10/246,911 filed on Sep. 18, 2002 now U.S. Pat. No. 6,741,024, which is a continuation of U.S. Ser. No. 09/296,921 filed Apr. 22, 1999, now U.S. Pat. No. 6,515,413.

BACKGROUND OF THE INVENTION

1. Field of the Invention

The present invention relates to light filter systems and more particularly, but not by way of limitation, to infrared light filter systems for fluorescent lighting.

2. Description of the Problem and the Related Art

Existing night vision systems collect light that cannot be seen by the human eye and focus that light on an image intensifier. Inside the image intensifier, a photo cathode absorbs the collected light energy and converts it into electrons. These electrons are then drawn through a microchannel plate (which multiplies the electrons thousands of times) to a phosphor screen. When the multiplied electrons strike the phosphor screen, they cause the screen to emit light that the human eye can see. Because the phosphor screen emits light in exactly the same pattern and degrees of intensity as the collected light, the bright, nighttime image viewable on the phosphor screen corresponds precisely to the outside scene being viewed.

The night vision industry has progressed through three stages or "generations": generation I, II and III. Although generation I technology is generally obsolete, generations II and III are in widespread use. Generation II technology, for instance, intensifies light up to 20,000 times, which means that this technology is effective in ¼ moonlight. The newest technology, generation III technology, however, provides a substantially higher intensification than does generation II technology. Furthermore, generation III technology, unlike generation I and II, is sensitive to near-infrared light, i.e., light in the 600-900 nanometer region. The ability of generation III technology to intensify light at and near the infrared region is important because most natural backgrounds reflect infrared light more readily than visible light. Thus, when infrared reflectance differences between discernable objects are maximized, viewing contrast increases and potential terrain hazards and other objects are distinguishable. Generation III technology's infrared capabilities complement this phenomenon and, accordingly, produce a sharp, informative image of an otherwise unviewable nighttime scene.

Furthermore, generation III technology can be modified to incorporate filters that substantially block visible light. These types of systems, known as aviator night vision systems, amplify light only in the near infrared and infrared region. Thus, aviator night vision systems allow the user to more clearly view terrain hazards and the like without interference from visible light.

Aviator night vision systems are useful in environments containing generated light such as light generated by an incandescent bulb. For example, a pilot of a search and rescue helicopter can require night vision capabilities to locate victims at night. The pilot needs to see not only the terrain being searched, but also the lighted helicopter instrument display. Furthermore, others aboard the helicopter may need internal lighting to perform their individual tasks, e.g., navigation. With standard generation III technology, the pilots ability to see the terrain would be greatly hampered by the visible light produced by the display and the lights used by others in the helicopter. In other words, standard generation III technology can pick-up and intensify the relatively high-intensity visible light produced inside the helicopter rather than pick-up and intensify the relatively low-intensity light on the surrounding terrain. In fact, in many cases the standard generation III night vision system could become momentarily inoperable because too much visible light reaches the collector and in effect, shuts down the entire night vision system. The pilot is thus left to fly blind or at least without night vision capabilities. Either option is likely unacceptable.

Aviator night vision systems, unlike standard generation III technology, filter out the visible light and leave only infrared light to stimulate the viewable phosphor screen. Accordingly, the visible light produced by displays or other lights inside the helicopter will not interfere with aviator night vision systems. The pilot wearing an aviator night vision system, thus, can watch the night terrain and attempt to locate victims without interference from visible light produced inside the helicopter.

Light sources, however, generally produce both visible light and infrared light. Thus, the helicopter display and any other light source used in the helicopter can produce infrared light that will interfere with even aviator night vision systems. For most light sources, however, infrared light can be filtered out, thereby minimizing its affect on aviator night vision systems. For example, existing displays and incandescent bulbs can be filtered so that the emit very little infrared light. Thus, if a search and rescue helicopter was equipped with infrared filtered lighting, the pilot could use an aviator night vision system without interference from the lighted display or any other internal lighting.

The use of Night Vision Imaging Systems (NVIS) as an aid to pilot vision during night visions has significantly increased in recent years. The types of aircraft utilizing the NVIS diversified, and other types of NVIS were developed to meet the individual needs of the various aviation groups. As such, the lighting requirements have been broken down into Types and Classes to give the user the ability to specify the type and class of the lighting system, depending on the type of NVIS being used in the aircraft. For example, some NVIS (Class A) utilize a 625 nanometer (nm) minus-blue objective lens filter, some NVIS (Class B) utilize a 665 nm minus-blue objective lens filter, and other NVIS may utilize various filters depending on the lighting and components required in different aircraft. The transmission requirements for Class A, Class B, and Class C lenses are shown and described in Appendix C of MIL-STD-3009.

Although the infrared light can be filtered out from many light sources, infrared light has not previously been effectively filtered from conventional-type fluorescent lighting. Accordingly, an invention is needed that effectively filters infrared light, for any NVIS application, from fluorescent lighting and, preferably, that is easily adapted to typical fluorescent lighting and assemblies. One skilled in the art can appreciated that such an invention would have application anywhere that night vision systems are used or anywhere that infrared needs to be blocked. For example, the present invention even can be used to prevent the detection of fluorescent lights by NVIS.

SUMMARY OF THE INVENTION

The present invention provides a method and apparatus that effectively filters infrared light from fluorescent lighting and that is easily adapted to typical fluorescent lighting and assemblies.

One exemplary embodiment of the present invention includes a cover for filtering a fluorescent lighting fixture. The cover includes an infrared filter for substantially preventing emission of infrared light from the fluorescent lighting fixture and a protective layer for preventing damage to the infrared filter.

Another aspect of the present invention relates to a method for filtering infrared light from a fluorescent lighting fixture. The method includes the steps of substantially preventing, via an infrared filter, emission of infrared light from the fluorescent lighting fixture and preventing damage, via a protective layer, to the infrared filter.

Another aspect of the present invention relates to a fluorescent lighting fixture. The fluorescent lighting fixture includes at least one fluorescent light source, a housing for retaining the at least one fluorescent light source, and a cover for substantially blocking infrared light from the at least one fluorescent light source.

BRIEF DESCRIPTION OF THE DRAWINGS

Various objects and advantages and more complete understanding of the present invention will become apparent and more readily appreciated by reference both to the following Detailed Description and to the appended claims when taken in conjunction with the accompanying Drawings wherein:

DETAILED DESCRIPTION

Figure 1A:
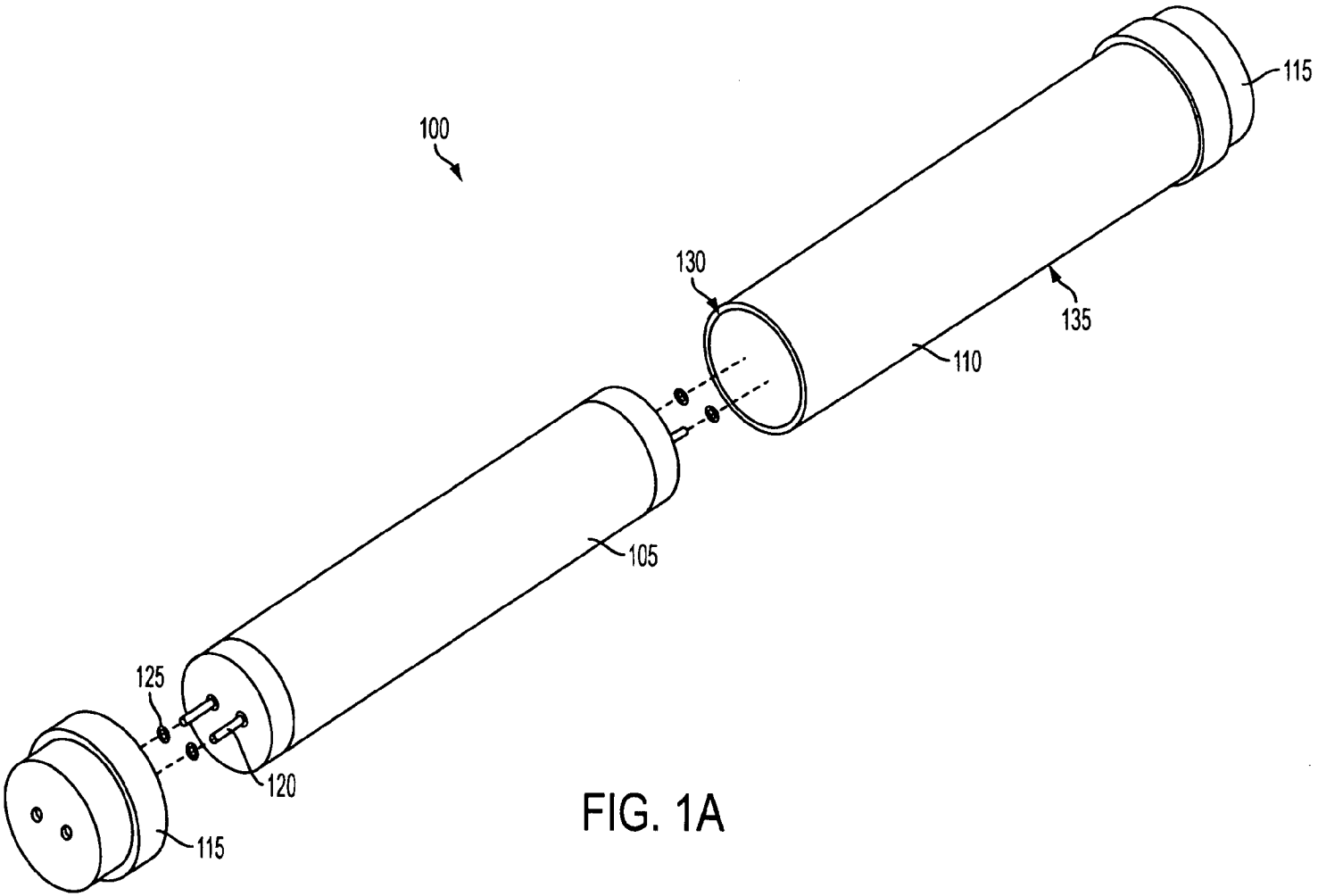
FIG. 1*a* is an exploded, frontal perspective view of an exemplary filter assembly in accordance with the present invention.

Although the present invention is open to various modifications and alternative constructions, preferred exemplary embodiments shown in the drawings are described herein in detail. It is to be understood, however, that there is no intention to limit the invention to the particular forms disclosed. One skilled in the art can recognize that there are numerous modifications, equivalences and alternative constructions that fall within the spirit and scope of the invention as expressed in the claims.

Accordingly, the present invention provides an effective infrared filter for fluorescent lighting. Furthermore, the present invention provides an effective infrared filter for fluorescent lighting that is easily adapted to typical fluorescent lighting. Additionally, the present invention can filter light in accordance with MIL Specifications MIL-L-85762A and MIL-STD-3009 which is incorporated herein by reference and attached as Exhibit A.

Referring now to FIG. 1*a,* there is illustrated an exploded, frontal perspective view of an exemplary filter assembly 100 in accordance with the present invention. The filter assembly 100 includes a transparent, cylindrical tube 110 with a diameter and length slightly greater than those of the fluorescent tube 105, which can be of any size or type. The filter assembly also includes a cap 115 placed on each end of the tube 110. Although both caps 115 may be removable, it is only necessary that one cap 115 be removable. As long as one cap 115 is removable, that cap 115 can be removed and the fluorescent tube 105 can be inserted into or removed from the tube 110. Furthermore, if one cap 115 is not removable, that cap 115 can be used to properly align the fluorescent tube 105 once placed inside tube 110.

Each cap 115 is perforated to receive the electrical contacts 120 of the fluorescent tube 105. The electrical contacts 120 pass through the cap 115 and can engage the electrical connections of a fluorescent fixture (not shown). Gaskets 125 are placed between the caps 115 and the ends of the fluorescent tube 105 and prevent light from escaping through the perforations in the cap 115. Furthermore, the gaskets 125 can slide over the electrical contacts 120 and thereby form a very effective light seal.

Because of the light seal formed by the caps 115 and the gaskets 125, all light generated by the fluorescent tube 105 must pass through the tube 110. However, a filter layer 130 (which can be flexible) is located between the tube 110 and the fluorescent tube 105. Therefore, all light produced by the fluorescent tube 105 must pass through the filter layer 130 where infrared light and near infrared light produced by the fluorescent tube 105 are blocked. Thus, all light emitted from the filter assembly 100 will be essentially infrared free and will not interfere with aviator night vision systems.

The filter assembly 100 can also include an opaque light blocker 135 that is preferably made of a scratch resistant material. The opaque light blocker 135 focuses the light emitted by the fluorescent tube 105 into a particular pattern. Furthermore, the opaque light blocker 135 can prevent light emitted from the filter assembly 100 from striking particular objects. For example, the opaque light blocker 135 can prevent light emanating from the filter assembly 100 from striking the interior portion of the fluorescent fixture (not shown) holding the filter assembly. Directing light away from the interior portion of a fluorescent fixture is important because even the filtered light emanating from filter assembly 100 will generate infrared light if it strikes red paint. Although the interior of most fluorescent fixtures are painted white, most white paint contains traces of red that can reflect infrared light. Thus, the opaque light blocker 135 can prevent the filtered light from striking areas, such as the interior of a fluorescent fixture, that will reflect infrared light and interfere with aviator night vision systems.

As can be appreciated, the present invention permits typical fluorescent lamps to easily and quickly be converted to only emit infrared-free light. For example, a typical fluorescent tube 105 can be converted to a non-infrared light emitting fluorescent source by merely removing one of the caps 115 from the tube 110. Next, gaskets such as gaskets 125 are placed over the electrical contacts 120 on both ends of the fluorescent tube 105. The fluorescent tube is then inserted into the tube 110 and aligned so that the electrical contacts 120 pass through the perforations in the non-removed cap 115.

Next, the previously-removed cap 115 is placed onto the tube 110 such that the electrical contacts 120 pass through the perforations in the cap 115. Finally, the entire filter assembly, including the fluorescent tube, can be inserted into a standard fluorescent fixture.

Figure 1B:
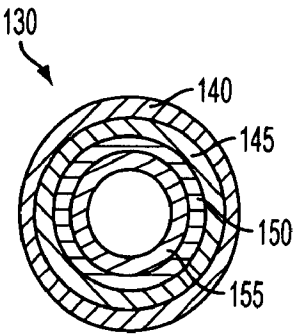
FIG. 1*b* is a cross-sectional view of a filter layer used with the filter assembly of FIG. 1*a;*

Referring now to FIG. 1*b* there is illustrated a cross-sectional view of a filter layer 130 used with the filter assembly 100 of FIG. 1*a*. The filter layer 130 can include four individual layers, all of which can be flexible. Going from outside to inside, the layers are green filter 140, infrared block 145, green filter 150 and green filter 155. Because infrared block 145 can be sensitive to heat, in this embodiment, it is not placed directly adjacent to the fluorescent tube 105.

Furthermore, the individual filter layers do not necessarily need to cover the entire surface area of the tube 105 as is illustrated in FIGS. 1*a* and 1*b*. Rather, in one embodiment, particular ones or even all of the layers of filter layer 130 cover only that portion of the tube 110 that is not covered by the opaque light blocker 135.

Although particularly good results have been obtained by using the above-described four layers, a significant portion of infrared light produced by the fluorescent tube 105 can be blocked by using just the infrared block 145 and either one green filter or two green filters, which can be various shades of green, such as green filter 155. Furthermore, although any effective infrared block can be used with the present invention, particularly good results have been obtained by using infrared block number 577-1086 produced by Hoffman Engineering, which is located at 22 Omega Drive, 8 Riverbend Center, P.O. Box 4430, Stamford, Conn. 06907-0430.

Green filter layers, such as green filter layer 155, can be added or removed to alter the transmission characteristics of filter assembly 100. As one skilled in the art can appreciate, if more light should be emitted, a green filter layer can be removed. Alternatively, if less light should be emitted, an additional green filter layer can be added. Furthermore, the transmission characteristics of the filter assembly 100 can also be altered by changing the size of the opaque light blocker 135. For example, if the opaque light blocker 135 is enlarged to cover 75% of the outside surface area of the tube 110, less light will be emitted than when the opaque light blocker 135 only covers 50% of the outside surface area of the tube 110.

In another embodiment of the present invention, the multiple layers of filter layer 130 are combined so that the same filtering and transmission properties can be obtained with a single layer filter or at least fewer layers. Furthermore, the filter layer 130 can be eliminated as a distinct element by incorporating the properties of the filter layer directly with the tube 110. In this embodiment, the infrared block and transmission reducers, if necessary, are formed directly into the tube 110.

Figure 2:
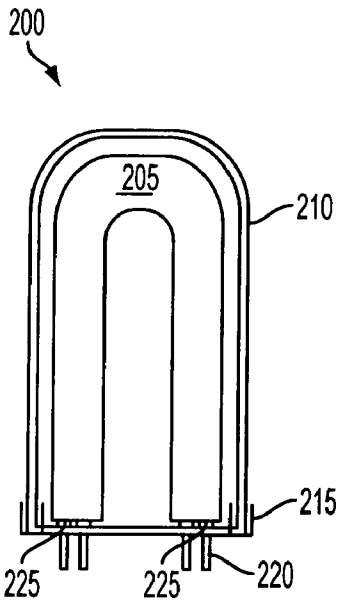
FIG. 2 illustrates a frontal view of an alternate embodiment of a filter assembly in accordance with the present invention.

Referring now to FIG. 2, there is illustrated a frontal view of an alternate embodiment of a filter assembly in accordance with the present invention. This embodiment includes a filter assembly 200 that filters infrared light from fluorescent tube 205. The filter assembly 200 includes a transparent cover 210 that fits over the fluorescent tube 205. The filter assembly 200 also includes a cap 215 (which can be opaque or clear) that is perforated to receive the electrical connectors 220 of the fluorescent tube 205. The electrical connectors 220 pass through the cap 215 and thereby can engage a fluorescent fixture (not shown). Gaskets 225 prevent unfiltered light from escaping through the perforations in the cap 215.

Additionally, the cover 210 can include an integrated infrared filter and transmission reducer (not shown). Alternatively, a flexible filter layer similar to filter layer 130 of FIG. 1 can be placed between the fluorescent tube 205 and the cover 210.

Figure 3:
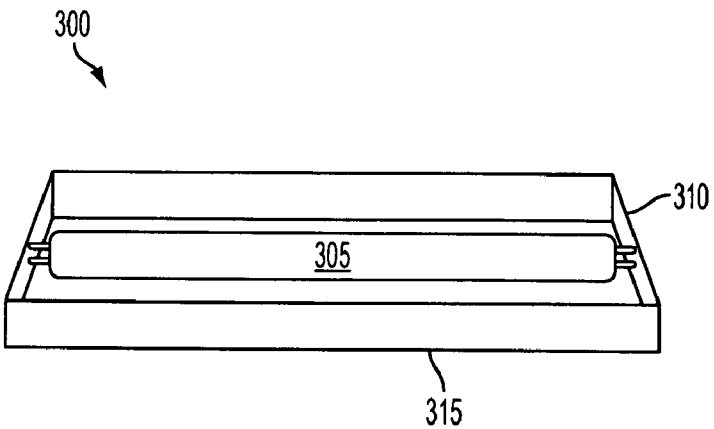
FIG. 3 illustrates a frontal view of a fluorescent fixture including a filter cover in accordance with the present invention.

Referring now to FIG. 3, there is illustrated a frontal view of a fluorescent fixture including a filter cover in accordance with the present invention. This embodiment includes a fluorescent fixture 300 such as would be suspended from a ceiling. The fluorescent fixture 300 includes a base 310 for receiving the fluorescent tube 305 and a cover 315 for blocking the infrared light generated by the fluorescent tube 305.

The cover 315 comprises an integrated infrared filter and, if needed, an integrated transmission reducer. For example, the cover 315 can be formed of a plastic or plastic-type material that incorporates infrared filters and transmission reducers. Alternatively, a filter layer, such as filter layer 130 (shown in FIG. 1) or an equivalent single layer, can be attached to the cover 315 such that the fluorescent fixture 300 emits only filtered light.

Figure 4:
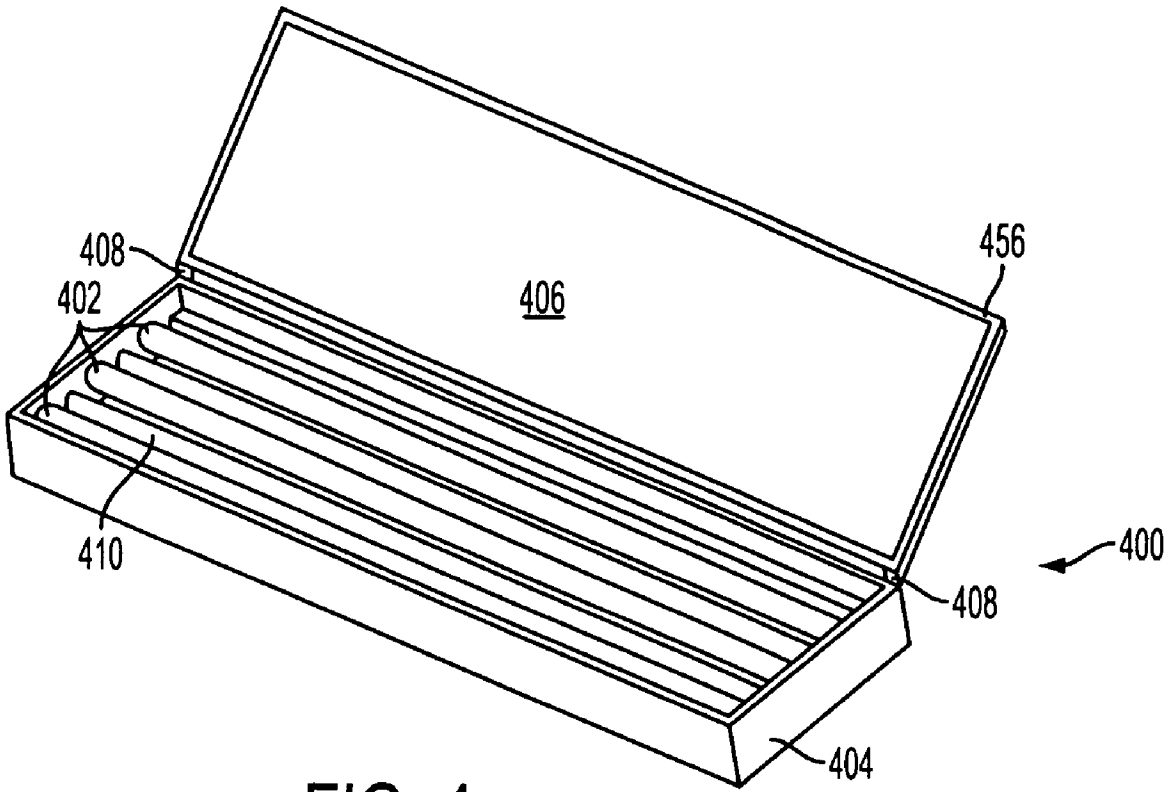
FIG. 4 illustrates a perspective view of an alternate embodiment of the present invention.

In an alternate embodiment of the present invention, an infrared filter may be formed as part of a cover over a fluorescent lighting fixture as shown in FIG. 4. Similar to the fixture in FIG. 3, fluorescent tube(s) 402 are connected to a housing 404 of the fluorescent lighting fixture 400. A reflector 410 reflects light from the rear of the housing 404 through a cover 406 for subsequent lumination. The cover 406, housed within a frame 456, includes infrared filtering capabilities as described in more detail below. The frame 456 preferably attaches to the housing 404 by a pivotal connection 408, however various pivotal or non-pivotal connection means may be implemented possible without departing from the scope of the present invention. The cover 406 closes over the fluorescent tubes 402 and spans the width and length of the housing 404.

Figure 5B:
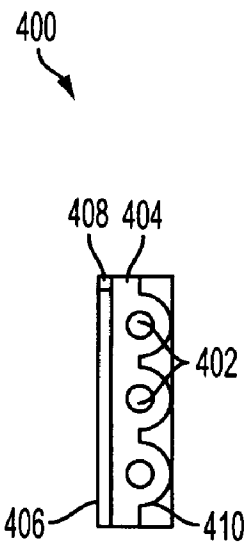
FIG. 5*b* illustrates a cross-sectional view of the alternate embodiment of the present invention as shown in FIG. 4.
Figure 5A:
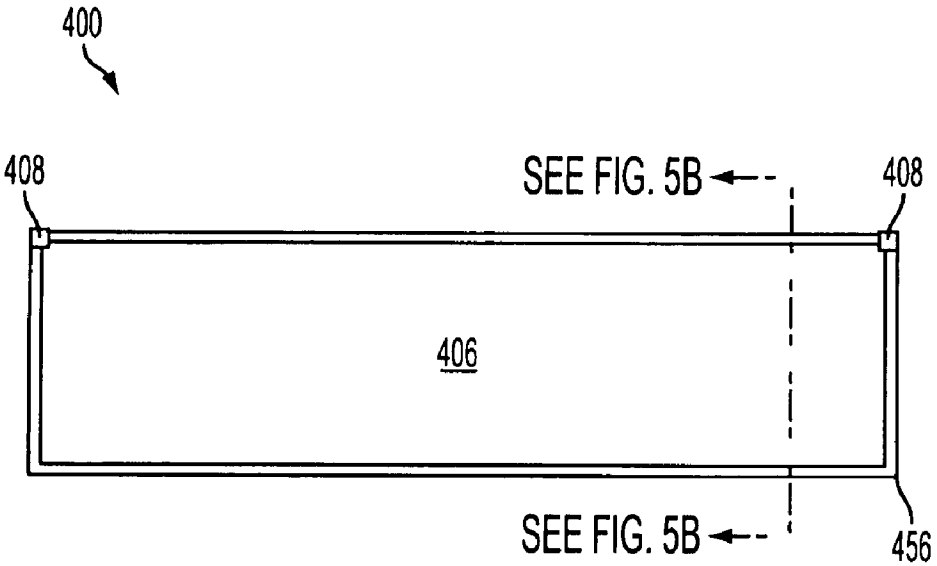
FIG. 5*a* illustrates a top view of the alternate embodiment of the present invention as shown in FIG. 4.

Referring now to FIGS. 5*a* and 5*b* in combination, a top plan view and cross-sectional view of the fluorescent lighting fixture 400 of the present invention is illustrated. As previously described, the cover 406 spans the entire width and length of the housing 404 so that preferably all of the light emitted passes through the cover 406 and is filtered to remove infrared light. The pivotal connection 408, as shown, attaches two corners of the frame 456 to two corners of the housing 404. It is understood that the pivotal connection 408, or any connection, may be oriented at the corners or anywhere along the edge of the cover 406 and housing 404. In addition, the pivotal connection 408 may span a central portion of the frame 456 and housing 404. The frame 456 includes one or more layers for filtering infrared light and/or colored light as described in detail below.

Figure 6:
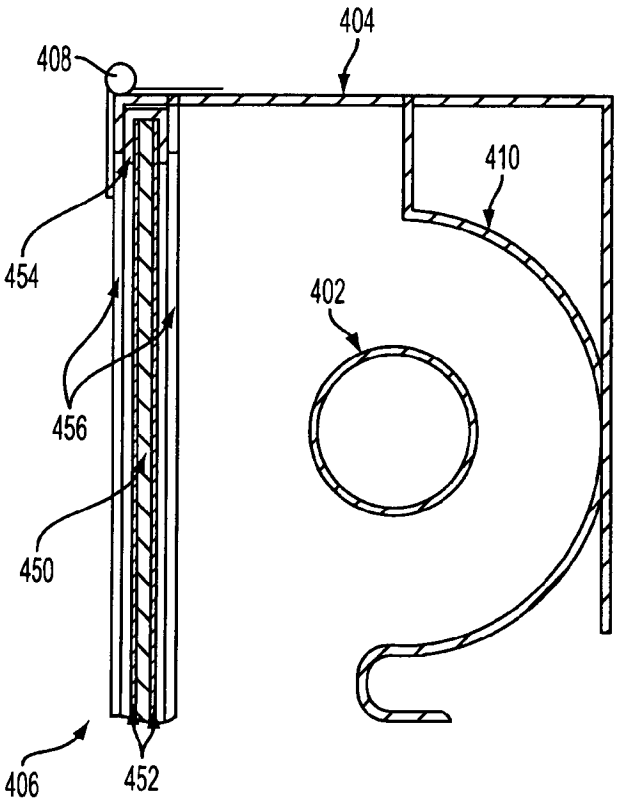
FIG. 6 illustrates a detailed view of the alternate embodiment as shown in FIG. 5*b*.

FIG. 6 illustrates the cover 406 and pivotal connection 408 of the present invention in greater detail. The cover 406 includes an infrared filter 450 for filtering infrared light in accordance with any of the NVIS specifications (e.g., NVIS Green A, Green B, "Leaky Green", NVIS Yellow, NVIS Red, NVIS White, etc.) as described in Appendix C of MIL-STD-3009. For example, an aircraft may require NVIS Green B-compatible lighting systems, while other aircraft may require NVIS Green A, or NVIS Yellow. In these applications, color filters (not shown) may be employed to shift the emitted light to the desired color range as described in more detail below.

In addition, the cover 406 may also include a protective layer 452 for preventing damage, such as scratches, to the infrared filter 450. The protective layer 452 is not necessary to filter infrared light in accordance with the present invention and may be omitted in some circumstances. The protective layer 452 may be formed of any substantially clear material such as polycarbonate or other material with light-transmission characteristics suitable for the light to be emitted from the fluorescent tubes 402. A gasket 454 is oriented substantially near the edges of the infrared filter 450 in order to prevent light leakage and minimize movement and/or damage to the infrared filter 450 during placement and use. The gasket 454 may be formed of any elastomeric material providing shock or movement absorption capabilities. A frame 456 holds the infrared filter 450 and protective layer 452 in place on the cover 406. The protective layer 452 and the frame 456 also allow easy installation of the infrared filter 450, reduce the possibility of a layer slipping out of position, and permit a light seal to be produced.

Figure 7:
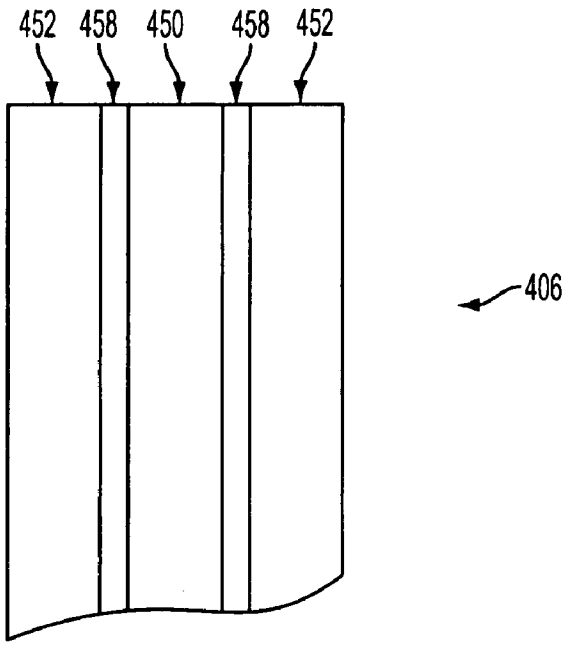
FIG. 7 illustrates a diagram of layers of a cover of the present invention as shown in FIG. 6.

Referring now to FIG. 7, a portion of the cover 406, showing the layers therein, is illustrated. The infrared filter 450 is located between two protective layers 452. The protective layer 452 may be formed of polycarbonate, as previously described, and may be approximately 0.010 inches thick, although other thicknesses may be utilized. To provide additional filtering capabilities, a color filter 458 may also be included in the cover 406. However, the color filter 458 is not necessary to implement the infrared-filtering capabilities of the present invention.

The color filter 458 may be any color, green or otherwise, for further altering the characteristics of the emitted light. The color filter 458 aids in limiting the visible transmission values for wavelengths of light amplified by the particular class of NVIS employed and also shifts the emitted light to the desired NVIS color range (e.g., NVIS Yellow). For example, to achieve a fixture 400 that blocks infrared light and shifts the emitted light to NVIS Yellow, the cover 406 may include the infrared filter 450 and a yellow color filter 458. In order to change the cover 406 to emit another color of light, such as NVIS Red, the yellow color filter 458 is replaced with another color filter such as a red color filter 458. The color filter 458 and the infrared filter 450 may be physically separable layers to exchange color filters 458 easily.

In summary, the present invention provides an effective infrared filter for fluorescent lighting. In addition to the above, a transmission reducer may also be inserted in the cover 406 for reducing the transmission of light through the cover 406. The protective layer 452 may also be tinted for reducing transmission instead of employing a separate transmission reducer. Also, the protective layer 452 may be tinted with color instead of employing a separate color filter 458.

Furthermore, the present invention may be utilized to cover windows so normal white light can not escape a room. For example, the windows of a control tower on an aircraft carrier may be installed with the infrared filter 450 and the color filter 458 to block infrared and predetermined colors of light. The window filters may be removable or fastened within a frame for attachment to the window. Additionally, the present invention can filter light in accordance with MIL Specification MIL-L-85762A and MIL-STD-3009.

Those skilled in the art can readily recognize that numerous variations and substitutions may be made in the invention, its use and its configuration to achieve substantially the same results as achieved by the exemplary embodiments described herein. For example, the NVIS color filters (e.g., NVIS Red, NVIS Yellow, etc.) may be applied to the tube designs as illustrated by FIGS. 1*a* and 2. Accordingly, there is no intention to limit the invention to the disclosed exemplary forms. Many variations, modifications and alternative constructions will fall within the scope and spirit of the disclosed invention as expressed in the claims.

What is claimed is:

1. A device for filtering light emitted from at least one fluorescent light emitter of a type having at least one electrical contact associated therewith, the device comprising:

a transparent sleeve adapted to receive the at least one fluorescent light emitter, the sleeve comprising:

at least one cap disposed on an end of the sleeve, the at least one cap having at least one hole disposed thereon, the at least one hole adapted to receive the at least one electrical contact of the at least one fluorescent light emitter;

a filter, the filter comprising the following distinct layers of material:

an infrared filter layer for substantially preventing emission of infrared light from the device, wherein the infrared filter layer comprises opposing sides;

a color filter layer for filtering a color of light from the device;

a plurality of protective layers for preventing damage to the infrared filter layer; and wherein the infrared filter layer is located between the plurality of protective layers.

2. The device of claim 1, wherein the color filter layer is a green filter layer.

3. The device of claim 1, wherein the infrared filter layer is Night Vision Imaging Systems Green A-compatible.

4. The device of claim 1, wherein the infrared filter layer is Night Vision Imaging Systems Green B-compatible.

5. The device of claim 1, further comprising:

a gasket for housing peripheral edges of the infrared filter layer, the plurality of protective layers, and the color filter layer so as to block infrared light leakage along the peripheral edge when the device is installed in a lighting fixture.

6. The device of claim 5, wherein the infrared filter layer is Night Vision Imaging Systems Green A-compatible.

7. The device of claim 5, wherein the infrared filter layer is Night Vision Imaging Systems Green B-compatible.

8. The device of claim 5, wherein the gasket is formed of an elastomeric material.

9. The device of claim 1, wherein the plurality of protective layers are formed of polycarbonate.

10. The device of claim 5, wherein the color filter layer is a green filter layer.

11. The device of claim 5, wherein the color filter layer is a yellow filter layer.

* * * * *